US010119354B2

(12) United States Patent
Wilie

(10) Patent No.: US 10,119,354 B2
(45) Date of Patent: Nov. 6, 2018

(54) WELL EMERGENCY SEPARATION TOOL FOR USE IN SEPARATING A TUBULAR ELEMENT

(71) Applicant: SHELL OIL COMPANY, Houston, TX (US)

(72) Inventor: Curtis Len Wilie, Friendswood, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/714,443

(22) Filed: Sep. 25, 2017

(65) Prior Publication Data

US 2018/0030800 A1 Feb. 1, 2018

Related U.S. Application Data

(62) Division of application No. 13/881,641, filed as application No. PCT/US2011/058292 on Oct. 28, 2011.

(Continued)

(51) Int. Cl.

| | |
|---|---|
| ***E21B 33/06*** | (2006.01) |
| ***E21B 29/02*** | (2006.01) |
| ***E21B 33/064*** | (2006.01) |

(52) U.S. Cl.

CPC ..... *E21B 33/06* (2013.01); *E21B 29/02* (2013.01); *E21B 33/063* (2013.01); *E21B 33/064* (2013.01)

(58) Field of Classification Search

None

See application file for complete search history.

(56) References Cited

U.S. PATENT DOCUMENTS 2,543,057 A * 2/1951 Porter ..... F42B 1/02 102/307

3,336,759 A 8/1967 Cooper (Continued)

FOREIGN PATENT DOCUMENTS

CN 2709641 Y 7/2005

OTHER PUBLICATIONS

International Search Report and Written Opinion received for PCT Patent Application No. PCT/US2012/053001, dated Jan. 30, 2013, 10 pages.

(Continued)

*Primary Examiner* — Matthew R Buck
*Assistant Examiner* — Douglas S Wood

(57) ABSTRACT

A method of separating a tubular element, comprising providing a tubular element having an inner and an outer surface, a circumference of said outer surface, and a first end and a second end; radially surrounding said tubular element with an explosive material, wherein said explosive material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element.

12 Claims, 5 Drawing Sheets

Related U.S. Application Data

(60) Provisional application No. 61/408,136, filed on Oct. 29, 2010.

(56) References Cited

U.S. PATENT DOCUMENTS 4,323,117 A * 4/1982 Pierce ..... E21B 29/02 102/307
4,602,794 A 7/1986 Schaeper et al.
4,685,521 A 8/1987 Raulins
5,046,563 A 9/1991 Engel et al.
5,133,419 A * 7/1992 Barrington ..... E21B 17/07 166/242.7
5,251,702 A 10/1993 Vazquez
5,253,585 A 10/1993 Hudak et al.
5,777,257 A 7/1998 Kenny
6,016,753 A 1/2000 Glenn et al.
6,089,526 A * 7/2000 Olson ..... E21B 33/062 251/1.1
6,125,928 A 10/2000 Ninivaara et al.
7,354,026 B2 4/2008 Urrutia
7,410,003 B2 8/2008 Ravensbergen et al.
7,779,760 B2 * 8/2010 Konig ..... E21B 43/118 102/306
7,789,153 B2 9/2010 Prinz et al.
8,393,393 B2 3/2013 Rodgers et al.
8,714,251 B2 5/2014 Glenn et al.
2002/0129940 A1 9/2002 Yang et al.
2005/0133419 A1 6/2005 Long et al.
2010/0147519 A1 6/2010 Goodman
2016/0290082 A1 * 10/2016 Younger ..... E21B 29/02

OTHER PUBLICATIONS

International Search Report and Written Opinion received for PCT Patent Application No. PCT/US2011/058292, dated May 11, 2012, 7 pages.

* cited by examiner

WELL EMERGENCY SEPARATION TOOL FOR USE IN SEPARATING A TUBULAR ELEMENT

PRIORITY CLAIM

The present application is a divisional of U.S. patent application Ser. No. 13/881,641, filed Apr. 25, 2013, which claims priority from PCT/US2011/058292, filed Oct. 28, 2011, which claims priority from U.S. provisional application 61/408,136, filed Oct. 29, 2010, the entireties of which are hereby incorporate by reference.

FIELD OF THE INVENTION

The invention is directed towards a method for separating a tubular element, particularly when the tubular element is suspended above a subsea well experiencing an undesired flow of produced fluids.

BACKGROUND

U.S. Pat. No. 5,253,585 discloses that a main charge of explosive is positioned symmetrically about a passageway-forming tubular member, such as a well pipe assembly. The charge is outwardly and radially spaced from the member and is coupled thereto by a dense medium, such as soil, which is adapted to transfer the produced explosive energy to the tubular member in the form of a pressure pulse applied by the medium. Initiation charges are supplied at the outer surface of the main charge, to initiate a detonation wave directed at the tubular member. A layer of dense medium is provided to confine the non-coupled surface of the charge and retard venting of explosive gases away from the tubular member. In the end result, concentrated, converging pressure pulses are applied to the tubular member on detonation, to cause it to be symmetrically crimped to restrict the passageway. U.S. Pat. No. 5,253,585 is herein incorporated by reference in its entirety.

U.S. Pat. No. 7,779,760 discloses a shaped charge assembly that comprises a housing, first shaped charge, a wave shaping relay charge and a second shaped charge located in the housing. The assembly is configured such that a first active element formed by initiation of the first shaped charge causes detonation of the wave shaping relay charge, which in turn causes initiation of the second shaped charge to form a second active element. The first active element moves beyond a second end of the housing to cause damage of a first kind to an external target and the second active element also moves beyond the second end to cause damage of a second kind to the target. Shaped charges are known in the art, and U.S. Pat. No. 7,779,760 is one example. U.S. Pat. No. 7,779,760 is herein incorporated by reference in its entirety.

U.S. Pat. No. 4,602,794 discloses an annular blowout preventer for use on an oil or gas well rig having a lower housing, an upper housing, a resilient sealing means, a vertical bore coaxially positioned through the housing and a vertically acting piston for actuating the sealing means in which the inner surface of the upper housing and the inner surface of the lower housing are concentric spherical surfaces extending to the bore. The resilient sealing means includes steel segments extending between the top and bottom of the sealing means and the top and bottom of the sealing means and the steel segments have spherical surfaces coacting with the spherical surfaces on the upper and lower housings. The upper and lower housings each include a vertical wall extending downwardly from the spherical surfaces on the upper and lower housing and the vertical moving piston sealingly engages the vertical walls. U.S. Pat. No. 4,602,794 is herein incorporated by reference in its entirety.

U.S. Pat. No. 7,354,026 discloses a unitary blade seal for a shearing blind ram of a ram-type blowout preventer and includes an elongate member having a generally semi-circular cross section with a curved upper surface and a lower surface. The lower surface has a pair of laterally extending sides that taper outwardly and have a metal outer cap bonded thereto. The metal outer caps form an acute angle that engages a complementary groove formed in the upper ram of the shearing blind ram assembly. U.S. Pat. No. 7,354,026 is herein incorporated by reference in its entirety.

U.S. Pat. No. 5,251,702 discloses a surface controlled, subsurface safety valve in which a force due to control pressure fluid from a first source at the surface for opening the valve is opposed in part by a force due to reference pressure fluid from a second source at the surface, whereby the valve closes in response to a fail condition. U.S. Pat. No. 5,251,702 is herein incorporated by reference in its entirety.

U.S. Pat. No. 6,089,526 discloses a ram type blowout preventor whose rams have variable ram packers for sealing about pipes of different sizes in the bore of the preventor housing. Each ram packer includes a body of elastomeric material installed with a slot across the face of a metal ram body slidable with a guideway intersecting the bore of the preventor body. First and second sets of metal segments embedded in the body of elastomeric material beneath a top plate embedded in the packer body are so constructed and arranged as to prevent extrusion of the elastomeric material as the packers seal about the different sizes of pipe. U.S. Pat. No. 6,089,526 is herein incorporated by reference in its entirety.

There is a need in the art for one or more of the following:

Improved systems and methods for severing tubular elements;

Improved systems and methods for remotely severing tubular elements;

Improved systems and methods for remotely severing tubular elements when the tubular elements are in a subsea well; and/or Improved systems and methods for remotely severing tubular elements when the tubular elements are suspended above a subsea well that is flowing oil and gas at an undesirable rate.

SUMMARY OF THE INVENTION

One aspect of the invention provides a method of separating a tubular element, comprising providing a tubular element having an inner and an outer surface, a circumference of said outer surface, and a first end and a second end; radially surrounding said tubular element with an explosive material, wherein said explosive material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element.

Another aspect of the invention provides a well emergency separation tool for separating a tubular element, comprising a tubular element having an inner and an outer surface, a circumference of said outer surface, and a first end and a second end; an explosive material, said explosive material radially surrounding said tubular element; a ram body, said ram body comprising an outer surface and an inner surface, said outer surface and said inner surface connected by a substantially flat face, wherein said flat face comprises an arcuate recess designed to engage a portion of said circumference of said tubular element, wherein at least a portion of said explosive material is contained with said ram body; and a trigger adapted to send an activation signal to said explosive material.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION

Presently preferred embodiments of the invention are shown in the above-identified figures and described in detail below. Embodiments may be described with reference to certain features and techniques for use on wells in a subsea environment.

Figure 1:
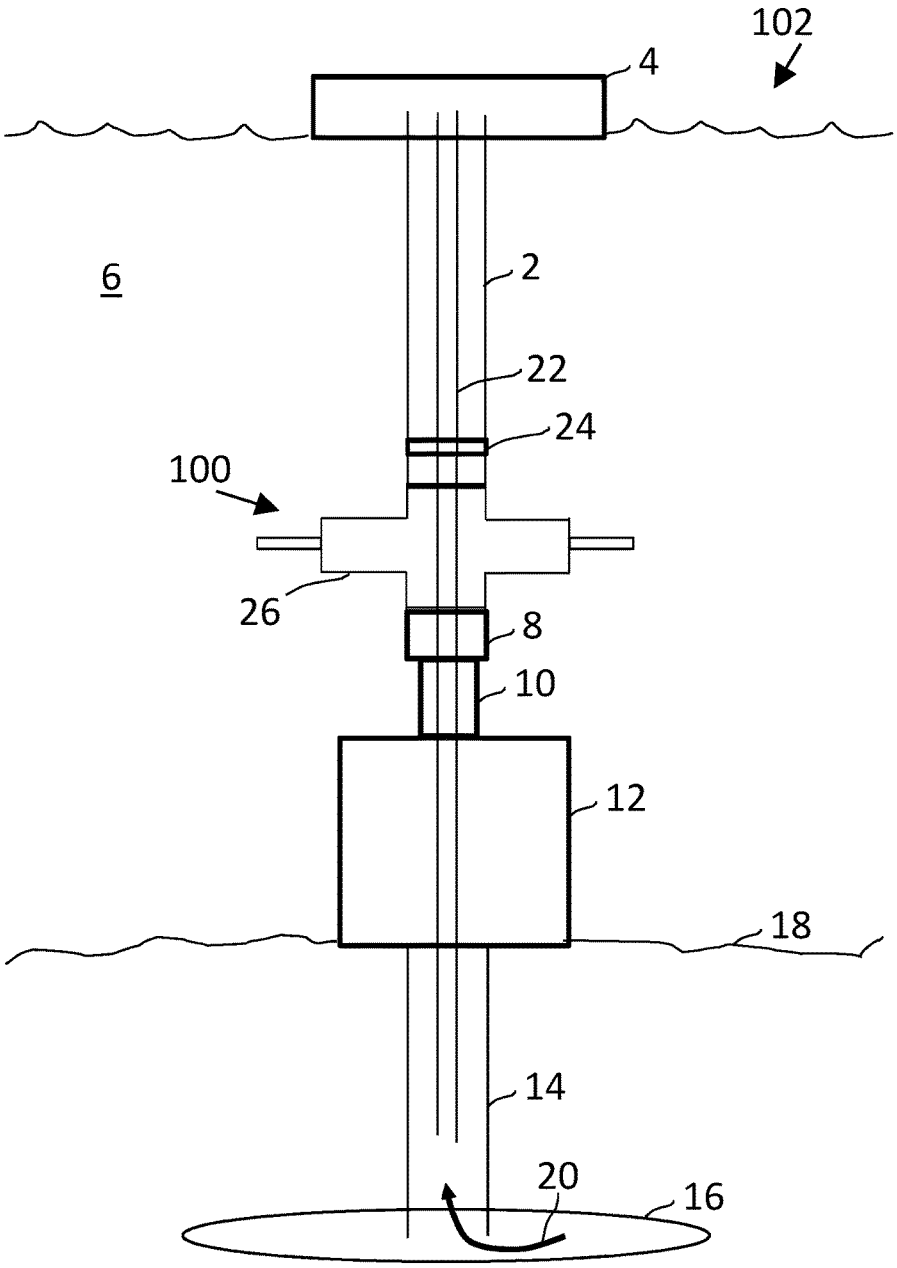
FIG. 1 is a schematic diagram depicting the well emergency separation tool positioned above a subsea reservoir.

FIG. 1:

FIG. 1 is a schematic diagram of well emergency separation tool 100 positioned about wellsite 102. Riser 2 is fluidly connected to surface structure 4. Suitable risers 2 are disclosed in U.S. Provisional Application 61/376,595, filed Aug. 24, 2010. U.S. Provisional Application 61/376,595 is herein incorporated by reference in its entirety.

Surface structure 4 floats on sea 6. Surface structure 4 may be, for example, a spar, a semisub, a TLP, an FPSO, a temporary or permanent storage system, a vessel, another containment apparatus, or a separator that separates components of fluid, such as gas and liquid, etc. Suitable surface structures 4 are disclosed in U.S. Provisional Application 61/376,542, filed Aug. 24, 2010; U.S. Provisional Application 61/376,534, filed Aug. 24, 2010; and U.S. Provisional Application 61/376,581, filed Aug. 24, 2010. U.S. Provisional Applications 61/376,542; 61/376,534; and 61/376,581 are herein incorporated by reference in their entirety.

Opposite surface structure 4, riser 2 is fluidly connected to well emergency separation tool 100. Well emergency separation tool 100 comprises ram housing 26. Ram housing 26 may be a metallic body as are known in the art, such as a standard forged body, provided by Cameron, Vetco-Gray, Patterson, Hydril, etc. Ram housing 26 contains a substantially vertical bore extending from riser 2 to flex joint 10. The outer surface of ram housing 26 may be fluidly isolated from sea 6. Opposite riser 2, well emergency separation tool 100 is fluidly connected to flex joint 10 by connector element 8. Flex joint 10 extends from connector element 8 to blowout preventer (BOP) stack 12. Casing 14 is a tubular element fluidly connected to BOP stack 12. BOP stack 12 may be located at or above mudline 18. BOP stack 12 may be any BOP stack as are known in the art and commercially available, such as those provided by Cameron, Vetco-Gray, Patterson, Hydril, etc. and disclosed, for example, in U.S. Pat. No. 7,410,003, herein incorporated by reference in its entirety. Fluid may flow from reservoir 16 through casing 14 towards surface in the direction marked by arrow 20.

During drilling or workover operations, workstring 22 may extend from surface structure 4 to casing 14. Workstring 22 is contained within riser 2 and passes through well emergency separation tool 100, connector element 8, flex joint 10, or BOP stack 12.

It may be desired to have multiple well emergency separation tools 100 installed between riser 2 and BOP stack 12. A second well emergency separation tool 100 may be included for redundancy. Alternatively, additional well emergency separation tools 100 may be included if various sizes or types of workstring 22 will be utilized. It may be desirable to install several sets of well emergency separation tools 100 to increase flexibility of design. Well emergency separation tool 100 may be installed when drilling operations commence and left on the BOP stack until all completion and workover activities are finished. Alternatively, well emergency separation tool 100 may be left on the well indefinitely and may be removed only when the well is decommissioned or when certain portions of well emergency separation tool 100 need to be repaired or replaced. Well emergency separation tool 100 is independent of traditional BOP stacks 12.

Figure 2:
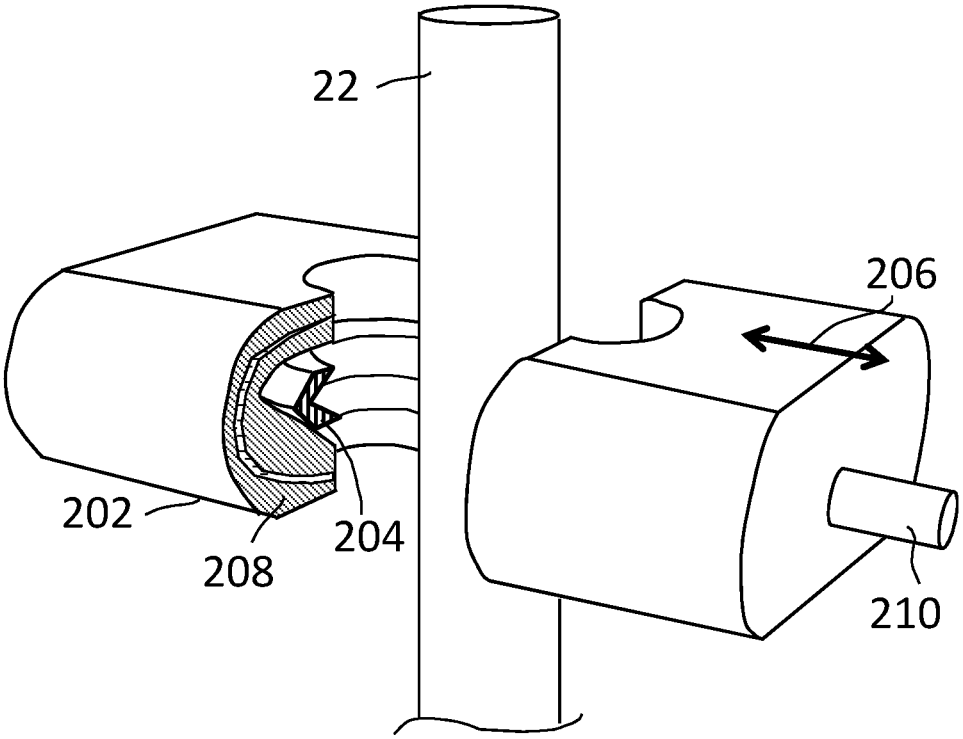
FIG. 2 is a schematic diagram of the internal structure of the well emergency separation tool.

FIG. 2:

FIG. 2 is a schematic diagram of the internal structure of ram housing 26. Workstring 22 may be a cylindrical element separated into approximately thirty to forty foot long sections called 'joints'. Workstring 22 may be a metallic element designed for oilfield use as is known in the art and commercially available from Patterson, Superior, Tuboscope, etc. Workstring 22 may be a small diameter workstring for use in well workovers, or workstring 22 may be a large diameter or heavy wall pipe used for drilling operations. Workstring 22 may range from about 1" (inch) up to 20" diameters. As seen in FIG. 1, workstring 22 passes through ram housing 26 in a substantially vertical manner.

Two opposing ram bodies 202 are contained within ram housing 26. Ram housing 26, as more fully discussed with reference to FIG. 1, is a standard ram housing 26 as is known in the art. Ram body 202 comprises an outer surface surrounded by ram housing 26 and an inner surface surrounding explosive material 204. Ram body 202 may be any standard ram body as is known in the art and available through commercial suppliers such as Cameron, Vetco-Gray, Patterson, Hydril, etc. The outer surface and the inner surface may be connected by a substantially flat face 208. Flat face 208 contains an arcuate recess designed to engage about one half the circumference of workstring 22. Opposing ram bodies 202 have complementary arcuate recesses designed to engage complimentary sections of the circumference of workstring 22 while also ensuring that opposing flat faces 208 properly abut. Ram body 202 may laterally translate towards or away from workstring 22 within ram housing 26, as shown by arrow 206. Lateral translation of ram body 202 is controlled by movable element 210. Movable element 210 may be a hydraulically activated piston, or may operate through alternative mechanical, hydraulic, etc. methods as are known in the art. The gap between workstring 22 and explosive element 204 may be controlled by the design of the arcuate recesses, flat faces 208, or movable element 210.

Ram housing and ram body design are known in the art and FIG. 2 merely provides a simplified diagram of one such design. FIG. 2 should not be taken to limit the present invention, the choice of the ram body design is not critical. Variable bore ram designs are also known in the art and may be used in the present invention, as disclosed in U.S. Pat. No. 6,089,526, herein incorporated by reference in its entirety.

Figure 3:
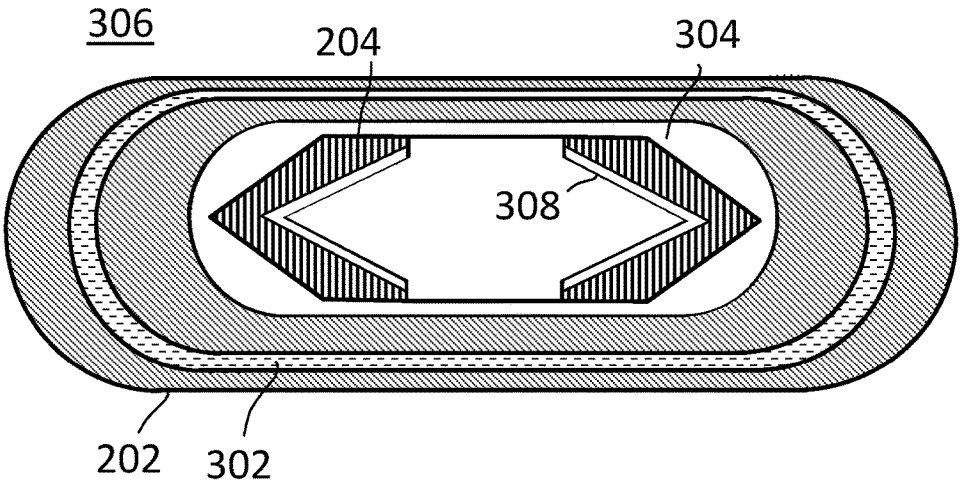
FIG. 3 is a cross-sectional view along the flat face of the ram body of the internal structure of the well emergency separation tool.

FIG. 3:

FIG. 3 contains a cross-sectional view along flat face 208 of FIG. 2. Sealing element 302 is fixedly connected to ram body 202 along flat face 208. Sealing element 302 may be an elastomeric sealing element, such as rubber, nitrile rubber, hydrogenated nitrile rubber, etc. as is known in the art. The inner surface of ram body 202 contains void 304. Void 304 surrounds explosive material 204.

Flat face 208 contains an arcuate recess designed to engage about one half the circumference of workstring 22. When the two ram bodies 202 abut along flat face 208, movable element 210 is designed such that opposing sealing elements 302 contact and begin to compress. As sealing elements 302 compress and extrude along flat face 208, sealing elements 302 sealingly isolate explosive material 204 from external environment 306, and any forces in external environment 306 from explosive material 204.

Explosive material 204 may contain an electrically conductive metallic liner 308, such as copper. When the two ram bodies 202 are abutted, sealing elements 302 compress and the opposing edges of metallic liner 308 contact and form a complete electrical circuit, allowing for a detonation signal to be conducted radially along explosive material 204.

Figure 4:
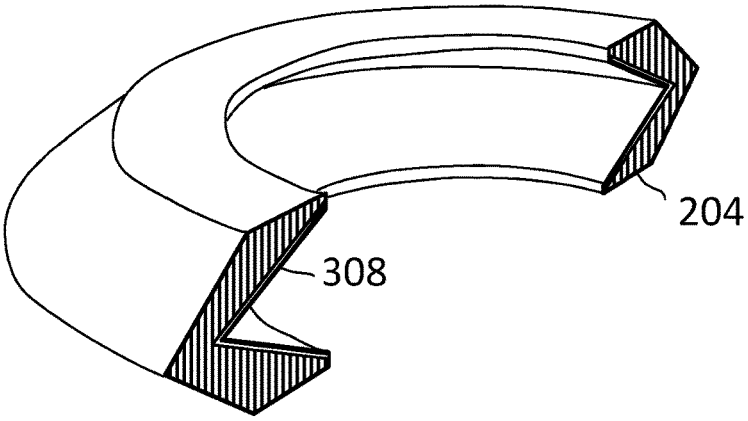
FIG. 4 is another view of one possible design of the explosive element contained within the well emergency separation tool.

FIG. 4:

FIG. 4 is another view of explosive material 204 as may be contained within ram body 202. The composition of explosive material 204 may be based on High Melting Explosive (HMX), Cyclotrimethylenetrinitramine (RDX), Hexanitrostilbene (HNS), Pentaerythritol tetranitrate (PETN), or any other explosive material known in the art. The composition, amount, or subsequent shape or design of explosive material 204 may be determined for a given application based on pressure, temperature, wall thickness, workstring 22 thickness, etc. The shape of explosive material 204 shown in FIG. 4 is purely illustrational and should not indicate a required shape.

Explosive material 204 may be designed such that when two ram bodies 202 are abutted, explosive material 204 radially encompasses a substantial portion of workstring 22 circumference to improve jet cutting characteristics. Shaped charges are known in the art, for example as disclosed in U.S. Pat. No. 7,779,760, which is herein incorporated by reference in its entirety. Explosive material 204 may be designed such that the high velocity jet of plasma is directed away from the inner surface of explosive material 204 and towards the outer surface of workstring 22.

Figure 5:
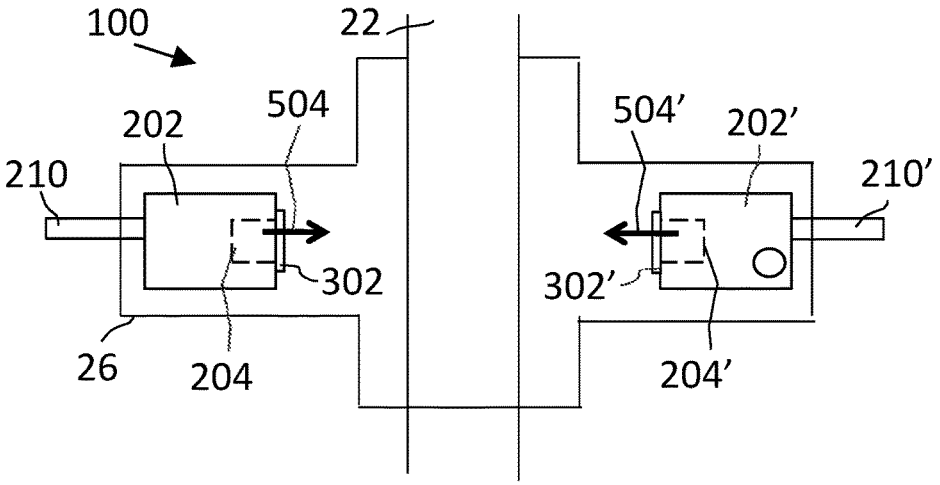
FIGS. 5-7 are schematic diagrams depicting a method of using the well emergency separation tool.
Figure 6:
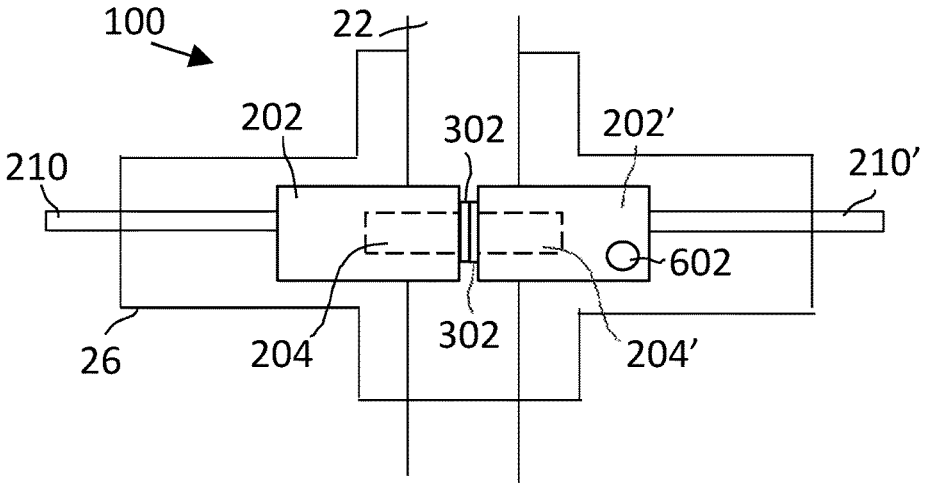
Figure 7:
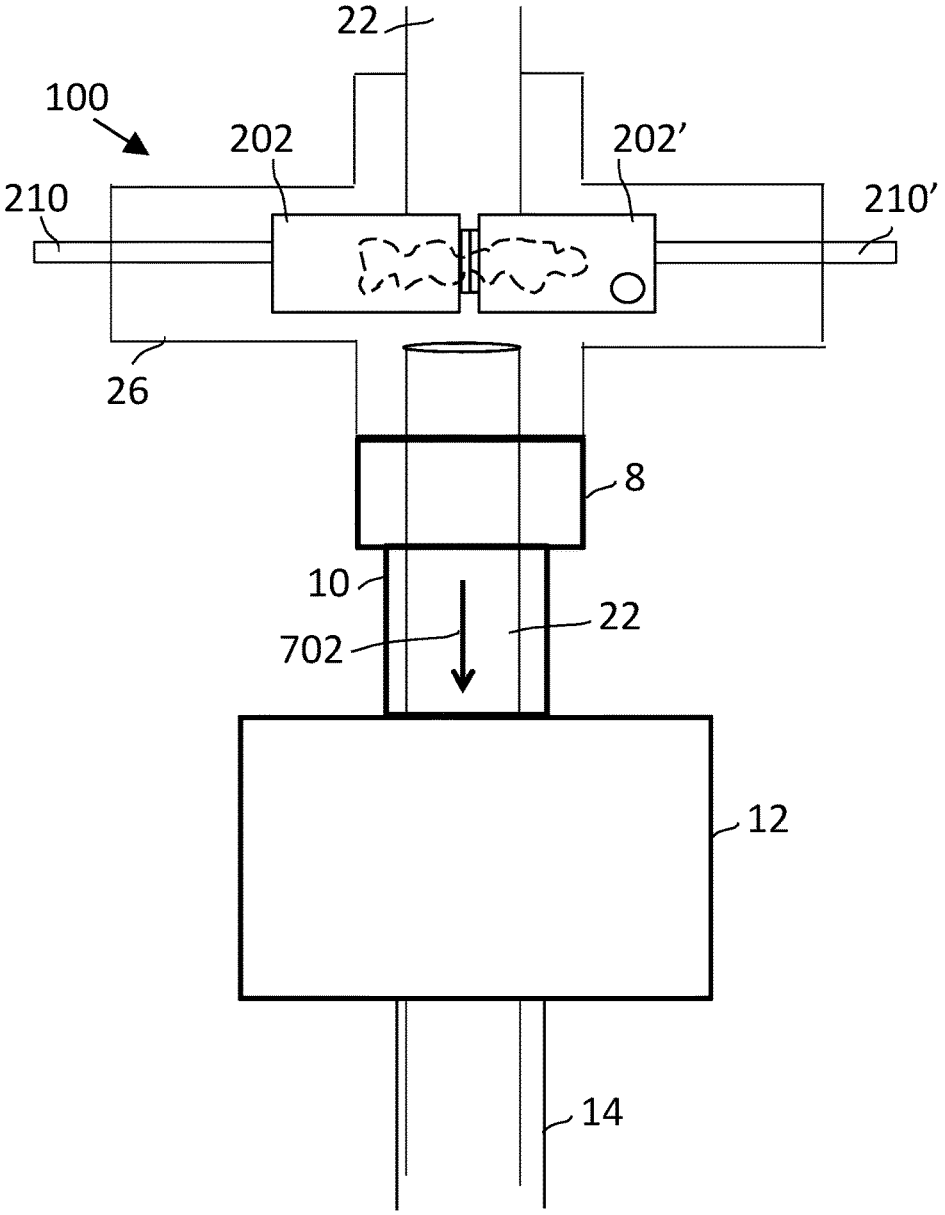

FIGS. 5-7:

FIGS. 5-7 contain a schematic diagram of how well emergency separation tool 100 may be used. All figures contain a close-up view of ram housing 26 as shown in FIG. 1. Only those items which differ from FIGS. 1-4 will be discussed herein, remaining features are more fully explained with respect to FIGS. 1-4.

In regular operating mode, FIG. 5, ram bodies 202, 202' are retracted away from workstring 22 in ram housing 26. Sealing elements 302, 302' are fixedly connected to ram bodies 202, 202' along flat faces 208. Workstring 22 passes through the bore of ram housing 26 in a substantially vertical manner. Workstring 22 is in line with the arcuate recesses of ram bodies 202, 202'.

When so desired, workstring 22 is secured at surface and movable elements 210, 210' are activated. Movable elements 210, 210' cause opposing ram bodies 202, 202' to translate laterally inward towards workstring 22, in the direction of arrows 504, 504'. Opposing ram bodies 202, 202' may translate laterally inwards at approximately the same speed.

As shown in FIG. 6, ram bodies 202, 202' translate toward each other and enclose workstring 22. The two sealing elements 302, 302' initially contact. When ram bodies 202, 202' are in the final position, sealing elements 302, 302' are compressed and sealingly isolate explosive material 204, 204'. Sealing elements 302, 302' may be designed so that proper stand-off between explosive material 204, 204' and workstring 22 is acquired. Ram bodies 202, 202' are abutted until the opposing edges of metallic liner 308 on explosive material 204 (shown in FIG. 3) contact and form a complete electrical circuit.

At this point, initiator 602 is electrically connected to explosive material 204, 204'. The location of initiator 602 in reference to FIG. 6 is merely one illustration and should not be taken as limiting. Initiator 602 may receive a detonation signal from a remote location and transmit that signal to activate explosive material 204, 204'. Initiator 602 may be any device capable of being integrated into well emergency separation tool 100 as is known in the art. A plurality of initiators 602 may be included for redundancy, such as 1-5 initiators, for example 2 initiators 602. Explosive material 204 may be designed such that a large pressure surge is created. A high-velocity jet of plasma will form, penetrate the outer surface of workstring 22, continue penetrating the entire thickness of workstring 22, and exit the inner surface of workstring 22, thereby cutting workstring 22. As explosive material 204, 204' may radially encompass workstring 22, the full circumference of workstring 22 will be cut, effectively severing workstring 22 into two distinct portions.

FIG. 7 is a schematic diagram of the system after workstring 22 is fully cut. According to FIG. 1, well emergency separation tool 100 is fluidly connected to flex joint 10 by connector element 8. Flex joint 10 extends from connector element 8 to BOP stack 12. Casing 14 is a tubular element fluidly connected to BOP stack 12. Once workstring 22 is fully cut, a portion of workstring 22 located below ram bodies 202, 202' falls in the direction of arrow 702 into the well. The newly cut end of workstring 22 passes through connector element 8, flex joint 10, and passes through BOP stack 12.

Attempting to close blind rams or blind-shear rams with workstring 22 across BOP stack 12 may be difficult or impossible depending on the size of workstring 22. Using the above method, workstring 22 is no longer located across BOP stack 12 and the blind rams or blind-shear rams may be effectively closed in order to effectively operate the BOP.

Once the newly cut end of workstring 22 has traveled through BOP stack 12, standard BOP rams may be shut to control the well. This method may be used in the case of uncontrolled flow from reservoir 16 through casing 14. This may include closing the blind rams and/or the blind-shear rams. Once the blind or blind-shear rams have been closed and the flowing fluids have temporarily halted, well emergency separation tool 100, riser 2, and surface structure 4 can be disconnected from BOP stack via connection element 8. Alternatively, movable elements 210, 210' may be retracted into ram housing 26 to allow tools to pass through the bore of ram housing 26. Appropriate remedial measures can then begin.

When explosive material 204 releases explosive energy, a high-velocity jet of plasma forms. In many cases a shock wave is also formed. It may be desired to incorporate a shock mitigator 24 (see FIG. 1) into riser 2. Shock mitigator 24 may be a solid barrier, such as a housing, or an energy absorbing material. Introduction of gas into a fluid may have a significant effect in reducing shock loading. Shock mitigator 24 may be a bubble curtain formed when pressurized gas is injected into the fluid contained within riser 2. One such desirable gas may be nitrogen for its inert properties. Introduction of pressurized gas into a fluid has been shown to reduce the effects of fluid shock up to a factor of ten. In the above sequence, shock mitigator 24 may be activated before explosive material 204 is activated to cut workstring 22. Although in FIG. 1, shock mitigator 24 is shown above well emergency separation tool 100, shock mitigator 24 may be integrated into well emergency separation tool 100 or located elsewhere in the system as is required for the given well and materials.

Illustrative Embodiments

In one embodiment, there is disclosed a method of separating a tubular element, comprising providing a tubular element having an inner and an outer surface, a circumference of said outer surface, and a first end and a second end; radially surrounding said tubular element with an explosive material, wherein said explosive material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element. In some embodiments, the method also includes securing said first end of said tubular element. In some embodiments, the method also includes completing an electrical circuit along said electrically conductive layer of said explosive material. In some embodiments, the method also includes providing a shock mitigator and activating said shock mitigator before said generating said high-velocity plasma jet step. In some embodiments, the shock mitigator is a bubble curtain formed by injecting an inert gas into a fluid. In some embodiments, the method also includes allowing said second portion of said tubular element to travel away from said first portion. In some embodiments, the tubular element is positioned above a wellsite, wherein said wellsite comprises a well flowing a produced fluid at a first rate and a flow control device connected to said well. In some embodiments, the method also includes closing said flow control device after said second portion of said tubular element has traveled away from said first portion. In some embodiments, the flow control device is a blowout preventer ram. In some embodiments, the method also includes providing a ram body, wherein at least a portion of said explosive material is contained with said ram body, said ram body having an outer surface and an inner surface, said outer surface and said inner surface connected by a substantially flat face, said flat face having an arcuate recess designed to engage a portion of said circumference of said tubular element and a sealing element fixedly attached to said flat face. In some embodiments, the method also includes compressing said sealing element. In some embodiments, the method also includes providing a ram housing, wherein said ram housing comprises a first ram body and a second ram body. In some embodiments, the method also includes laterally translating said first ram body and said second ram body toward said tubular element, said first ram body radially encompassing a first portion of said circumference of said tubular element, and said second ram body radially encompassing a second portion of said circumference of said tubular element. In some embodiments, the method also includes laterally translating said first ram body and said second ram body away from said tubular element after said separating said tubular element into said first portion and said second portion step.

In one embodiment, there is disclosed a well emergency separation tool for separating a tubular element, comprising a tubular element having an inner and an outer surface, a circumference of said outer surface, and a first end and a second end; an explosive material, said explosive material radially surrounding said tubular element; a ram body, said ram body comprising an outer surface and an inner surface, said outer surface and said inner surface connected by a substantially flat face, wherein said flat face comprises an arcuate recess designed to engage a portion of said circumference of said tubular element, wherein at least a portion of said explosive material is contained with said ram body; and a trigger adapted to send an activation signal to said explosive material. In some embodiments, the tool further comprises a sealing element fixedly attached to said flat face. In some embodiments, the tool further comprises a first ram body and a second ram body. In some embodiments, the tool further comprises a ram housing, said ram housing having a thru-bore and an outer surface fluidly isolated from an external environment, wherein said first ram body and said second ram body are contained with said ram housing. In some embodiments, the tool further comprises a shock mitigator, wherein said shock mitigator is located external to said ram housing. In some embodiments, the tool further comprises a wellsite, wherein said wellsite comprises a subsea well flowing a produced fluid, a flow control device fluidly connected to said well, and a riser, wherein said well emergency separation tool is fluidly connected between said flow control device and said riser. In some embodiments, the flow control device is a blowout preventer. In some embodiments, the tool further comprises a plurality of well emergency separation tools fluidly connected between said flow control device and said riser.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of separating a tubular element, comprising:

providing a tubular element having an inner and an outer surface, a circumference of said outer surface, and a first end and a second end;

providing opposing first and second ram bodies, each capable of translating towards and away from the tubular element within a ram housing, and having an outer surface surrounded by the ram housing and an inner surface surrounding an explosive material;

causing the opposing ram bodies to translate radially inward towards the tubular element, thereby radially surrounding said tubular element with said explosive material, wherein said explosive material is capable of generating a high-velocity plasma jet in response to an activation signal, and wherein said explosive material comprises an electrically conductive layer, and wherein a complete electric circuit is formed by abutting the ram bodies;

transmitting said activation signal to said explosive material;

generating said high-velocity plasma jet; and separating said tubular element into a first portion comprising said first end and a second portion comprising said second end when said high-velocity plasma jet penetrates said outer surface of said tubular element and exits said inner surface of said tubular element.

2. The method of claim 1, further comprising securing said first end of said tubular element.

3. The method of claim 1, further comprising completing an electrical circuit along said electrically conductive layer of said explosive material.

4. The method of claim 1, further comprising providing a shock mitigator and activating said shock mitigator before said generating said high-velocity plasma jet step.

5. The method of claim 4, wherein said shock mitigator is a bubble curtain formed by injecting an inert gas into a fluid.

6. The method of claim 1, further comprising allowing said second portion of said tubular element to travel away from said first portion.

7. The method of claim 1, wherein said tubular element is positioned above a wellsite, wherein said wellsite comprises a well flowing a produced fluid at a first rate and a flow control device connected to said well.

8. The method of claim 7, further comprising closing said flow control device after said second portion of said tubular element has traveled away from said first portion.

9. The method of claim 8, wherein said flow control device is a blowout preventer ram.

10. The method of claim 1, said outer surface and said inner surface of said ram body are connected by a substantially flat face, said flat face having an arcuate recess designed to engage a portion of said circumference of said tubular element and a sealing element fixedly attached to said flat face.

11. The method of claim 10, further comprising compressing said sealing element.

12. The method of claim 1, further comprising laterally translating said first ram body and said second ram body away from said tubular element after said separating said tubular element into said first portion and said second portion step.

* * * * *